US005078040A

United States Patent [19]

Shibukawa

[11] Patent Number: 5,078,040

[45] Date of Patent: Jan. 7, 1992

[54] ELECTRONIC MUSICAL INSTRUMENT PROVIDING TRANSPOSITION DURING PLAYING

[75] Inventor: Takeo Shibukawa, Hamamatsu, Japan

[73] Assignee: Yamaha Corporation, Hamamatsu, Japan

[21] Appl. No.: 464,913

[22] Filed: Jan. 16, 1990

[30] Foreign Application Priority Data

Jan. 19, 1989 [JP] Japan ..... 1-010796

[51] Int. Cl.[5] ..... G10R 1/20

[52] U.S. Cl. ..... 84/619; 84/657; 84/445

[58] Field of Search ..... 84/445, 619, 657, 685

[56] References Cited

U.S. PATENT DOCUMENTS

| | | | |
|---|---|---|---|
| 4,724,736 | 2/1988 | Isozaki | 84/619 X |
| 4,922,797 | 5/1990 | Chapman | 84/650 |
| 4,993,307 | 2/1991 | Sakashita | 84/615 |

FOREIGN PATENT DOCUMENTS

| | | |
|---|---|---|
| 62-25597 | 2/1984 | Japan . |
| 62-31354 | 7/1987 | Japan . |

*Primary Examiner*—William M. Shoop, Jr.
*Assistant Examiner*—Brian Sircus
*Attorney, Agent, or Firm*—Spensley Horn Jubas & Lubitz

[57] ABSTRACT

When an operation to give a transposition instruction is performed during generation of musical tone, the transposition is not performed for the musical tone being generated but the transposition is performed for only the specific musical tone to which the musical tone generating instruction is given newly.

4 Claims, 6 Drawing Sheets

ELECTRONIC MUSICAL INSTRUMENT PROVIDING TRANSPOSITION DURING PLAYING

BACKGROUND OF THE INVENTION

1. Field of the Invention

This invention relates to an electronic musical instrument, especially improvement of transposition timing control system.

2. Description of the Prior Art

Some electronic musical instruments have a transposition function to play music of transposing instrument (such as clarinet) or to play music of C major with another tonality. The transposition function allows the player to play several tonalities such as C major and G major with the same fingering using specific switch.

The conventional electronic musical instrument is designed so that as soon as the transposition operation is performed (setting of transposition mode or changing of amount of transposition), all the pitches are shifted according to the above-mentioned operation. Accordingly, if the transposition operation is performed while a musical tone is being generated (namely untransposed tone exists), this musical tone is also transposed, which is a disadvantages of the conventional electronic musical instrument. Therefore, the player who uses the conventional electronic musical instrument has to perform the transposition operation after all the musical tones are cleared, which impedes smooth operation. Moreover, it has another disadvantage that the untransposed musical tone and the transposed musical tone cannot be generated jointly.

SUMMARY OF THE INVENTION

It is an object of this invention to provide an electronic musical instrument in which the above-mentioned problems are solved by transposing from the musical tone which is generated after completion of transposition operation.

The electronic musical instrument of this invention can shift (transpose) tonality upward and downward. This function enables, for example, transposition from original tonality upward by minor third and playing of flat B major with C major fingering. Such a transposition operation is executed also during playing of music if it continues, being modulated. If in this case the transposition operation (an instruction to specify the amount of transposition) is made while the untransposed (unmodified) musical tone is being generated, the amount of transposition is stored tentatively in the memory. Transposition of the musical tone being generated is not performed. Transposition is performed from the musical tone to be generated subsequently (shift means). This affords an allowance for transposition operation timing and makes it possible to generate simultaneously the untransposed musical tone and the transposed musical tone.

BRIEF DESCRIPTION OF THE DRAWINGS

FIG. 1 (B) shows the partial configuration of RAM of switch display panel.

FIG. 3 (A) shows the main routine. FIG. 3 (B) shows the transposition switch control routine. FIG. 3 (C) shows the UP/DOWN switch control routine. FIG. 3 (D) shows the keyboard control routine. FIG. 3 (E) shows the tone generation routine.

DESCRIPTION OF THE PREFERRED EMBODIMENT

Figure 1A:
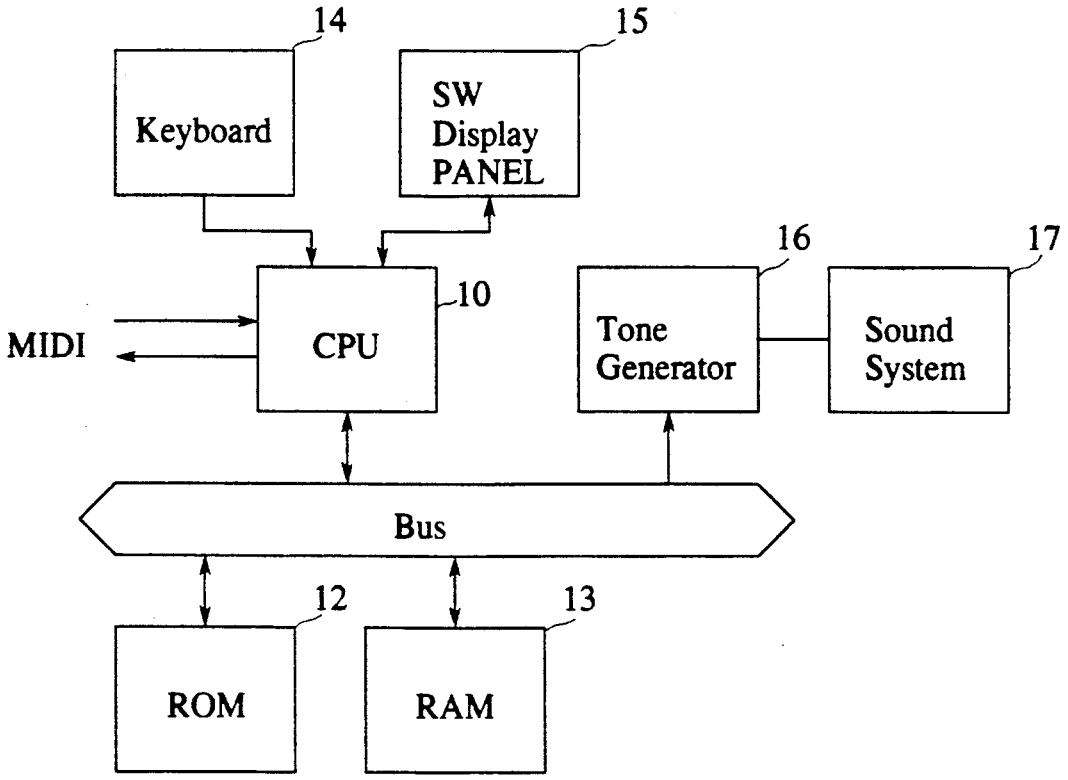
FIG. 1 (A) is a block diagram showing the control section of electronic musical instrument which is an example of embodiment of this invention.
Figure 1B:
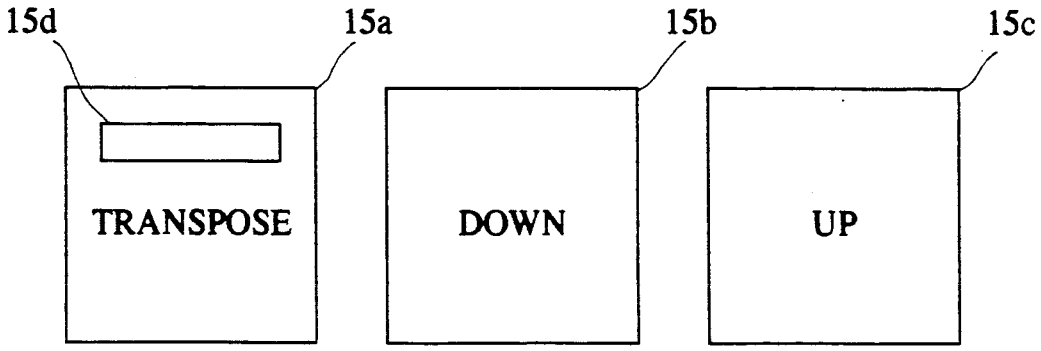

FIG. 1 (A) is a block diagram showing the control section of electronic musical instrument which is an example of embodiment of this invention. This electronic musical instrument is keyboard type instrument. By operating a keyboard 14 two or more musical tones can be simultaneously generated. Usually the keyboard is set to C major key tonality. It is possible to transpose to any tonality by transposition operation. A bus 11 is connected to CPU10 designated to control this electronic musical instrument. The keyboard 14 and a switch display panel 15 are also connected to CPU10 through the built-in I/O ports. This CPU10 has the terminal to send to and receive from external equipment the MIDI data. A ROM12 storing the program data, a RAM13 having various registers and a sound source circuit (tone generator) 16 having several channel sound generating sections are connected to the bus 11. A sound system 17 designated to amplify the musical tone signal outputted as analog electric signal and to output it from the speaker is connected to the sound source circuit 16. FIG. 1 (B) shows a part of switch group which is provided on the switch display panel 15. 15*a* is a transposition switch. 15*b* and 15*c* are DOWN switch and UP switch, respectively. When the transposition switch 15*a* is pressed, the transposition mode is set or canceled. When the DOWN switch 15*b* or UP switch 15*c* is pressed in the transposition mode, the tonality of keyboard is shifted down or up by semitone. The up/downrange is within 6 semitones (argumented fourth interval). The transposition switch 15*a* has a built-in LED 15*d* which lights when the transposition mode is set.

Figure 2:
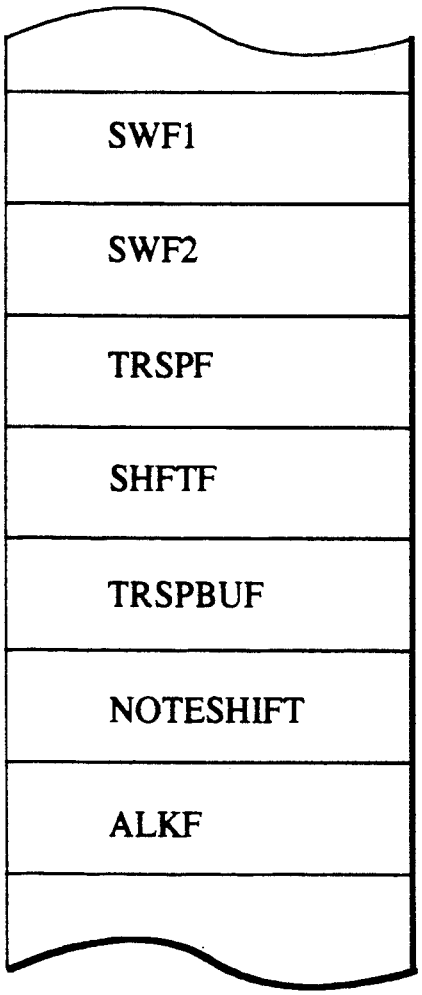
FIG. 2 shows the partial configuration of RAM of this control section.
Figure 3A:
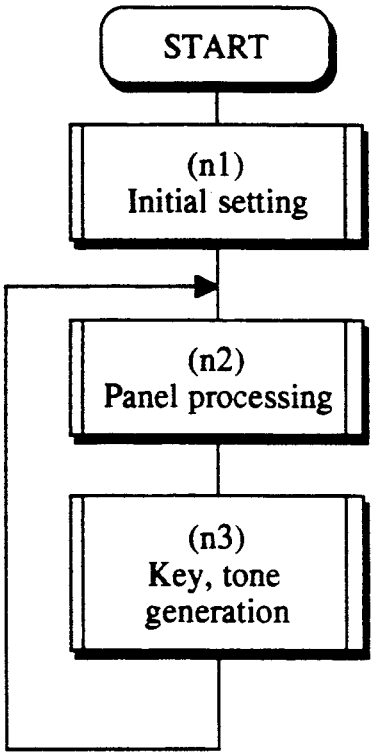
FIGS. 3 (A) to (E) are flow charts showing the operation of the control section.
Figure 3B:
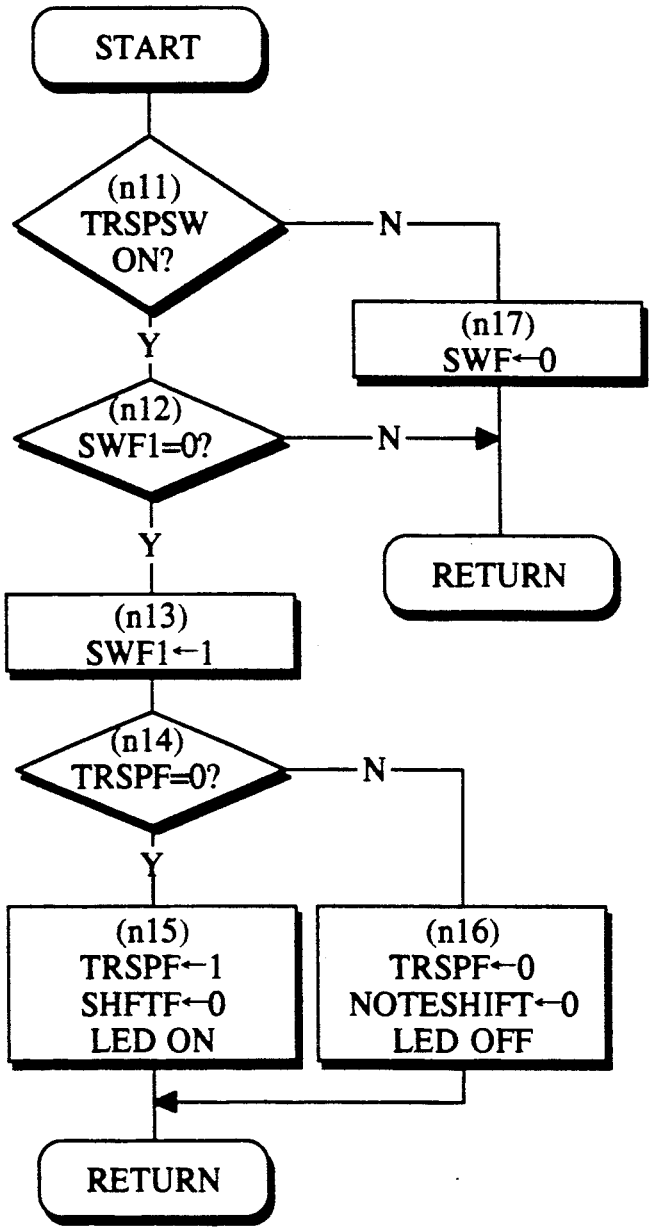
Figure 3C:
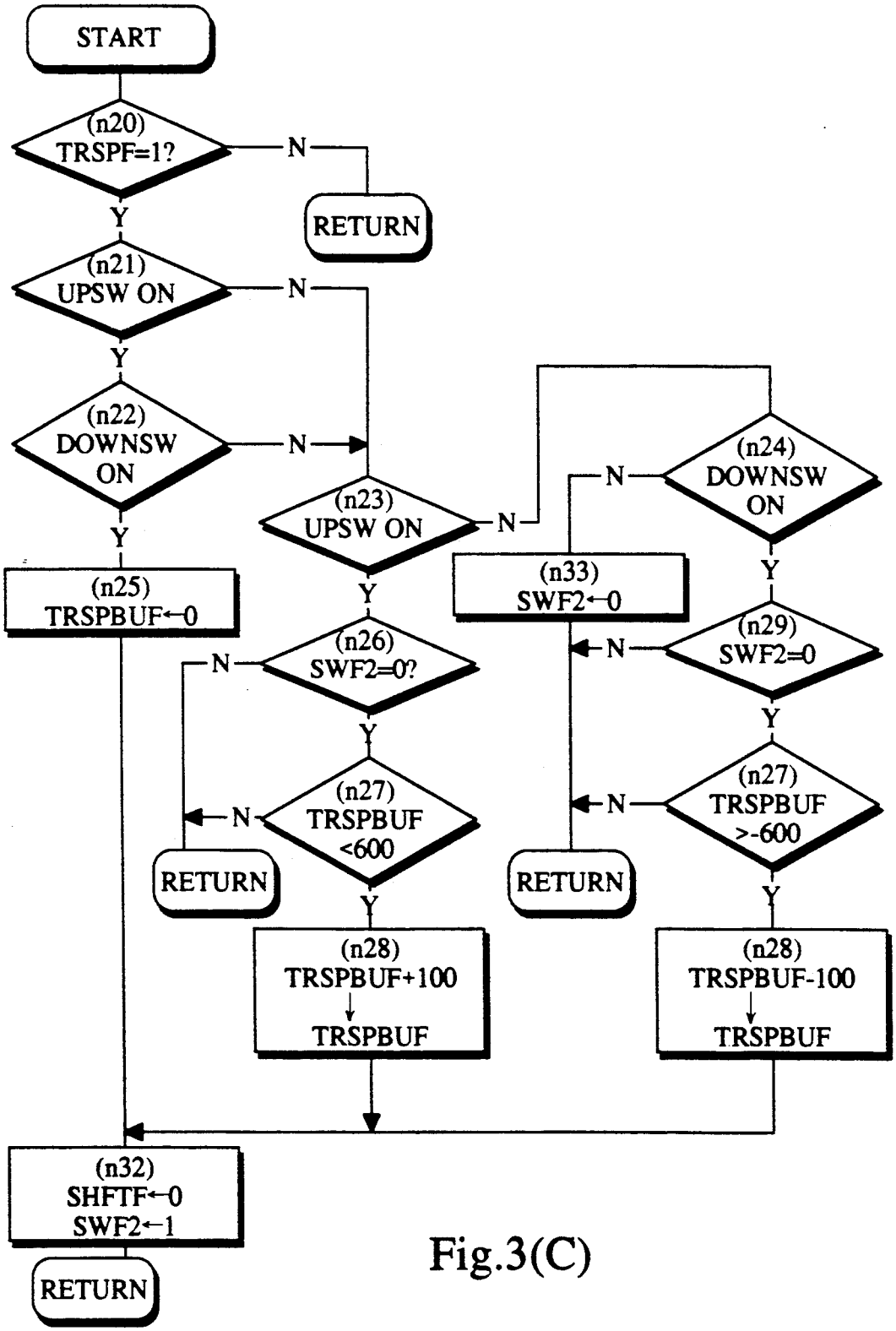
Figure 3D:
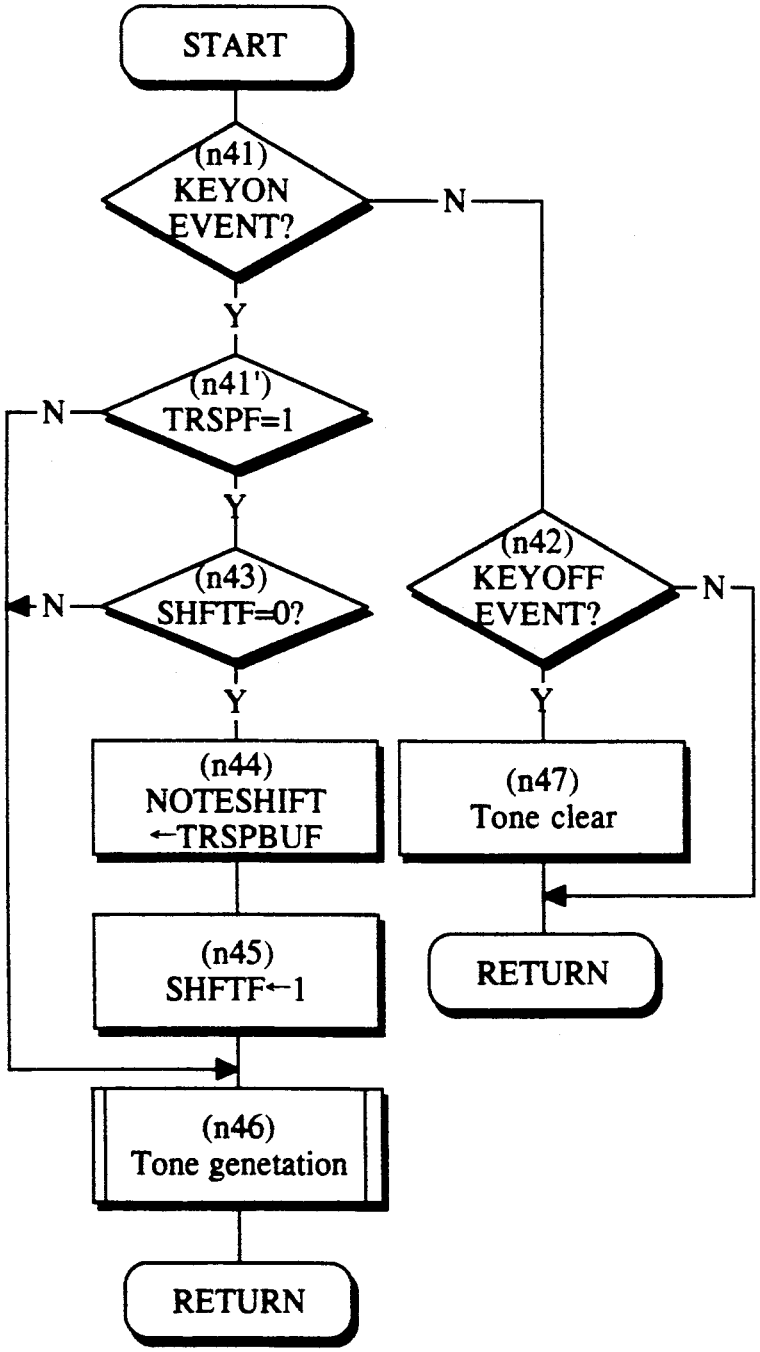
Figure 3E:
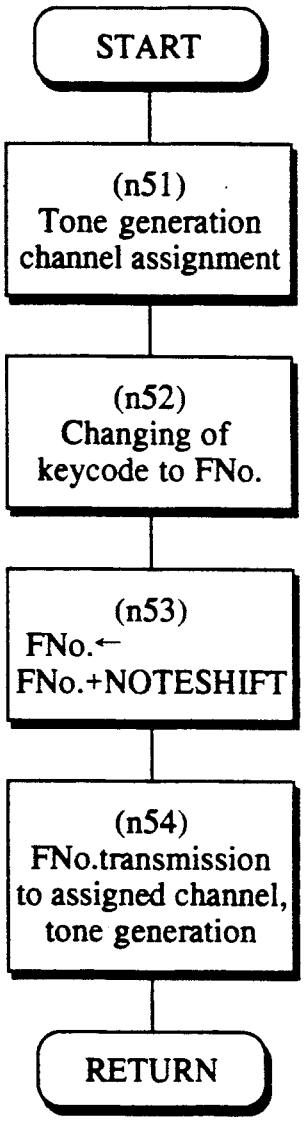

FIG. 2 shows a part of register which is set in the RAM13.

SWF1 is a transposition switching flag. It memorizes that switching operation by once pressing the transposition switch has been executed so that the switching operation is not repeated twice or more by one pressing.

SWF2 is the up-down switching flag. It memorizes that transposition has been executed by once pressing the UP switch or DOWN switch so that the transposition is not repeated twice or more by one pressing.

TRSPF is a transposition mode flag which memorizes that the transposition mode has been set.

SHFTF is a transposition completion flag which memorizes that the transposition of specified amount has been finished (in real operation it memorizes that the content of TRASPBUF discussed later has been transferred to the NOTESHIFT register).

TRSPBUF is a transposition amount buffer which memorizes the amount of transposition which is set by the UP/DOWN switch.

NOTESHIFT is a transposition amount register which memorizes the amount of transposition which is specified to the keyboard.

In TRSPBUF and NOTESHIFT the amount of transposition is stored as F number (=cent: 1 octave is expressed with 1200, semitone is expressed with 100).

ALKF is an all-key OFF flag which memorizes that all keys are OFF. This flag is used to execute the transposition while all the keys are OFF.

Below is given an explanation of operation of the electronic musical instrument, referring to the flow chart shown in FIG. 3. FIG. 3 (A) shows the main routine. FIG. 3 (B) shows the transposition switch control routine. FIG. 3 (C) shows the UP/DOWN switch control routine. FIG. 3 (D) shows the keyboard control routine. FIG. 3 (E) shows the tone generation routine.

In FIG. 3 (A), when power is turned on, at first the initial setting such as resetting of register is executed (n1), so that the musical instrument gets ready to operate. After that, switch/display panel input/output (n2) and key scan/tone generation (n3) are repeatedly executed until the power is turned off.

In FIG. 3 (B), at first ON/OFF of transposition switch 15*a* is judged (n11). Unless the transposition switch 15*a* is ON, the transposition switch flag SWF1 is reset (n17), and the process returns. If the transposition switch 15*a* is ON, a judgment as to whether or not SWF1 has been set is executed (n12). If it has been set, the operation by turning-on of this switch is regarded to have been completed, and the process returns. IF SWF1 has been reset, SWF1 is set (n13), and the transposition mode flag TRSPF is referenced to (n14). If TRSPF has been reset, the operation of n15 is executed to set the transposition mode. If TRSPF has been set, the operation of n16 is executed to cancel the transposition mode. At the step n15 TRSPF is set, and at the same time the transposition completion flag SHFTF is reset, and LED15*d* is lighted. Moreover, at the step n16 TRSPF is reset, the transposition amount register NOTESHIFT is reset to restore the original tonality, and LED15*d* is turned off.

In FIG. 3 (C), at first a judgment as to whether or not TRSPF has been set is executed (n20). If it has been reset, the current mode is not transposition mode. Therefore operation of UP/DOWN switch does not affect, and the process returns. If it has been set, the process proceeds to the following steps. At the steps n21, n22, n23 and n24 a judgement as to operation state of UP switch 15*c* and DOWN switch 15*b* is performed. If both UP switch 15*c* and DOWN switch 15*b* are ON (n21, n22), this means that the transposition amount clear operation has been done. Therefore the transposition amount buffer TRSPBUF is cleared (n25), and the process proceeds to n32.

When the UP switch 15*c* is ON, the process proceeds to n26 and n27 from n23, and the content of UP/-DOWN switch flag SWF2 and TRSPBUF is judged. If SWF2 has been set, it is judged that the operation by turning-on of this switch has been completed, and the process returns (n26). If TRSPBUF exceeds 600, it is judged that further upward transposition is impossible, and the process returns (n27). If SWF2 has been reset and the TRSPBUF is less than 600, 100 (semitone) is added to TRSPBUF (n28), and the process proceeds to n32.

If the DOWN switch 15*b* has been turned on, the process proceeds to n29 and n30 from n24, and the content of SWF2 and TRSPBUF is judged. If SWF2 has been set, it is judged that the operation by turning-on of this switch has been completed, and the process returns (n29). If TRSPBUF is less than −600, it is judged that further downward transposition is impossible. And then the process returns (n30). If SWF2 has been reset and TRSPBUF is larger than −600, 100 (semitone) is subtracted from TRSPBUF (n31), and the process proceeds to n32.

At the step n32 the SET COMPLETION flag SHFTF is reset, and rewriting of transposition amount register NOTESHIFT is enabled (discussed latter), and since the operation by turning-on of switch has been completed, SWF2 is set. Even when this routine is started again while the UP switch or DOWN switch is ON after SWF2 has been set, the process returns at the step n26 or n29. Therefore reexecution of n28 and n31 can be avoided. If these switches are once turned off, SWF2 is reset at the step n33. Therefore if these switches are turned on next time, n28 or n31 is executed. Accordingly, the UP switch 15*c* or DOWN switch 15*b* executes only one semitone shift operation (transposition operation) when they are turned on once.

In FIG. 3 (D), at first a judgment as to existence/-nonexistence of key ON event or key OFF event is performed at the step n41, n42. If key ON event is found, the process proceeds from n41 to n41', and a judgment as to whether or not TRSPF has been set is performed. If TRSPF has been set, this means that the current mode is transposition mode. Consequently, the operation of step n43 and on is performed. If TRSPF has been reset, the process proceeds directly to tone generation of n46. At the step n43 a judgment as to whether or not SHFTF has been reset is performed. If SHFTF has been reset, this means that the amount of transposition has not been set yet. Therefore, after the content of TRSPBUF is transferred to the NOTESHIFT register (n44), SHFTF is set (n45), and the process proceeds to the tone generation process (n46). If SHFTF has been set, the process proceeds directly to tone generation process of n46. If key OFF event is found, the key OFF code is sent to the pertinent channel to perform tone clearing (n42 to n47), and the process returns.

FIG. 3 (E) shows the tone generation operation which is executed at the step n46. At the step n51 a tone generation channel is assigned to the key ON musical tone, and the key code of original tonality (key code of C major key) of key which has been set to ON is changed to F number (n52). Then, the content of NOTESHIFT is added to this F number to determine the F number of real tone generation (n53), the musical tone data including this F number is sent to the assigned channel to generate tone (n54).

With the electronic musical instrument mentioned above, the amount of transposition can be stored in the tentative memory even when the transposition operation (instruction to specify the amount of transposition) is performed during playing. Therefore the musical tone being generated is not transposed, but the transposition can be performed for the musical tone which is generated newly. As a result of which shift of tone being generated is impeded, the transposition timing gets allowance, and untransposed musical tone can be generated together with transposed musical tone.

Figure 4:
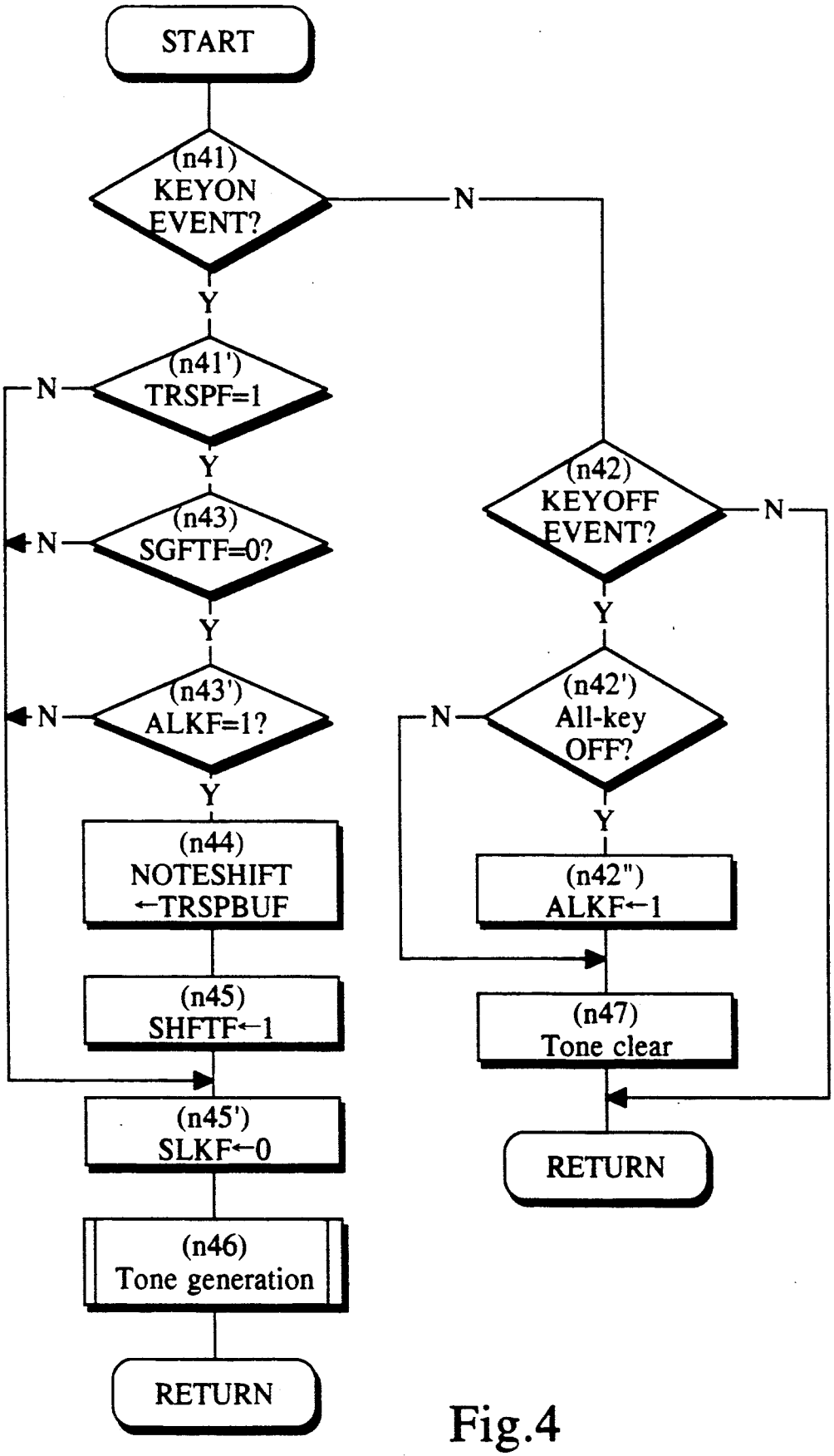
FIG. 4 is a flow chart of the control section, which is the second example of the invention.

FIG. 4 is a flow chart of keyboard control routine shown in FIG. 3 (D) which is another example of embodiment of this invention. At first at the step n41 and n42 ajudgment as to existence/nonexistence of key ON event or key OFF event is performed. If key ON event is found, the process proceeds from n41 to n'41, and a judgment as to whether or not TRSPF has been set is performed. If TRSPF has been set, this means that the current mode is transposition mode, and therefore, the process proceeds to the step n43 and on. At the step n43 and n43' the state of all-key OFF flag ALKF is judged. If SHFTF has been reset and ALKF has been set, the content of TRSPBUF is transferred to the NOTE-SHIFT register (n44), and then SHFTF is set (n45). Then ALKF is reset (n45'), and the process proceeds to tone generation process (n46). If TRSPF has been reset, when SHFTF has been set, and when ALKF has been set, the process proceeds directly to n45'.

If key OFF event has been found, a judgement as to whether or not all-key is OFF is performed (n42'). If all-key is OFF, ALKF is set (n42''), and then tone clear of n47 is performed. If all-key is not OFF, tone clear is performed without setting ALKF.

What is claimed is:

1. An electronic musical instrument comprising:

means for generating musical tones in response to musical tone generating instructions, wherein a tone generating instruction is provided for each tone to be generated;

means for providing an instruction to transpose musical tones, and means for transposing tones during tone generation, said means transposing only those musical tones for which musical tone generating instructions are newly given after said transposition is instructed without affecting any tones being generated at the time transposition is instructed.

2. The electronic musical instrument according to claim 1 including means for setting the amount of transposition so as to set the amount of transposition of any new musical tones.

3. An electronic musical instrument comprising:

means for generating musical tones in response to musical tone generating instructions, wherein a tone generating instruction is provided for each tone to be generated, means for providing an instruction to transpose musical tones, and means for transposing tones during tone generation, said means transposing only those musical tones for which a tone generating instruction is newly given after said transposition is instructed and after all musical tones which were being generated at the time transposition was instructed are cleared.

4. The electronic musical instrument according to claim 3, including means for setting the amount of transposition so as to set the amount of transposition of any new musical tone.

* * * * *